US005547641A

United States Patent [19]

Smith et al.

[11] Patent Number: 5,547,641

[45] Date of Patent: Aug. 20, 1996

[54] CATALYTIC CONVERTER EXHAUST SECTION FOR AN INTERNAL COMBUSTION ENGINE

[75] Inventors: Aaron L. Smith; Scott T. White, both of East Peoria, Ill.

[73] Assignee: Caterpillar Inc., Peoria, Ill.

[21] Appl. No.: 370,693

[22] Filed: Jan. 10, 1995

[51] Int. Cl.[6] ..... B01D 50/00; B01D 53/34; F01N 3/10

[52] U.S. Cl. ..... 422/181; 422/180; 422/211; 422/222; 55/DIG. 30; 55/DIG. 24; 60/299; 60/300; 60/302

[58] Field of Search ..... 422/171, 180, 422/181, 211, 222; 55/DIG. 30, DIG. 24; 60/299, 302, 300

[56] References Cited

U.S. PATENT DOCUMENTS

| | | | |
|---|---|---|---|
| 4,814,146 | 3/1989 | Brand et al. | 422/179 |
| 4,840,028 | 6/1989 | Kusuda et al. | 60/303 |
| 4,843,815 | 7/1989 | Smojver | 60/299 |
| 4,866,932 | 9/1989 | Morita et al. | 60/288 |
| 4,882,130 | 11/1989 | Asai et al. | 422/310 |
| 5,009,065 | 4/1991 | Howe et al. | 60/288 |
| 5,016,438 | 5/1991 | Harris | 60/299 |
| 5,042,249 | 8/1991 | Erdmannsdoerfer | 60/299 |
| 5,108,716 | 4/1992 | Nishizawa | 422/171 |
| 5,169,604 | 12/1992 | Crothers, Jr. | 422/177 |
| 5,203,742 | 3/1994 | Gillingham et al. | 60/288 |
| 5,209,062 | 5/1993 | Vollenweider | 60/280 |
| 5,318,757 | 6/1994 | Abe et al. | 422/174 |

FOREIGN PATENT DOCUMENTS

94/13939 6/1994 Germany .

*Primary Examiner*—Nina Bhat
*Attorney, Agent, or Firm*—Liell & McNeil

[57] ABSTRACT

A catalytic converter exhaust section comprises a first mounting plate, a second mounting plate, a hollow cylindrically shaped metallic tube and a plurality of substantially identical metallic catalytic converter substrates arranged in a honeycomb pattern. Each of the catalytic converter substrates has a regular hexagonal cross section and an inlet end separated from an outlet end by six planer walls. The metallic substrates are attached in parallel to form a compound honeycomb cross section with an inlet side, an outlet side, and an outer border defined by a portion of the planer walls. The compound honeycomb cross section is affixed within the tube between the first mounting plate and the second mounting plate. The individual substrates are coated with an appropriate catalyst for treatment of a particular exhaust component. The present invention finds particular applicability to treating exhaust from relatively large internal combustion engines that require a catalytic converter cross section larger than that currently possible with monolithic catalytic converter substrates.

9 Claims, 3 Drawing Sheets

CATALYTIC CONVERTER EXHAUST SECTION FOR AN INTERNAL COMBUSTION ENGINE

TECHNICAL FIELD

This invention relates generally to catalytic converter exhaust sections, and more particularly to compound catalytic converters for large internal combustion engines.

BACKGROUND ART

Although catalytic converters for relatively small engine applications are well known, federal regulations are only recently requiring reduction of harmful emissions from large internal combustion engines. Examples of such large engines include generator sets, ship engines, etc. Because of the large amount of emissions produced by such engines, a catalytic converter exhaust section must have a relatively large cross section in order to adequately treat exhaust gases without producing undesirable back pressure on the engine. Experience has shown that these engines require catalytic converter cross sections at least one foot in diameter, and sometimes a converter cross section exceeding three or more feet is required. Unfortunately, the current state of the art in both metallic and ceramic catalytic converter substrates limits their cross section to diameters of less than one foot. Consequently, catalytic converters for large engine applications must necessarily include a plurality of available catalytic converter substrates arranged in parallel in order to adequately treat exhaust flow without creating detrimental back pressure on the engine.

In addition to the problems normally encountered in catalytic converters for smaller engines, catalytic converters for relatively large engines naturally take on additional problems not previously encountered. For instance, it is generally desirable that catalytic converters for large engines be serviceable while remaining structurally sound in the extreme temperature and pressure environment of engine combustion exhaust. The present invention is directed to overcoming these problems.

DISCLOSURE OF THE INVENTION

A catalytic converter exhaust section according to the present invention includes a plurality of substantially identical metallic monolithic catalytic converter substrates, each having a hexagonal cross section and an inlet end separated from an outlet end by six planer walls. The metallic substrates are attached in parallel to form a compound cross section having a honeycomb appearance with an inlet side, an outlet side and an outer border defined by a portion of the planer walls. The compound honeycomb cross section is contained within a hollow cylindrically shaped tube with an inlet end separated from an outlet end by a wall impervious to exhaust. The compound cross section is affixed within the tube and between a first mounting plate with an inlet opening and a second mounting plate with an outlet opening.

In one aspect of the invention the catalytic converter exhaust section is assembled with mechanical fasteners, such as bolts and clips, in order to provide serviceability to the individual catalytic converter substrates. In another aspect of the invention, the various components are welded together such that the complete unit is replaced during servicing.

BEST MODE FOR CARRYING OUT THE INVENTION

Figure 1:
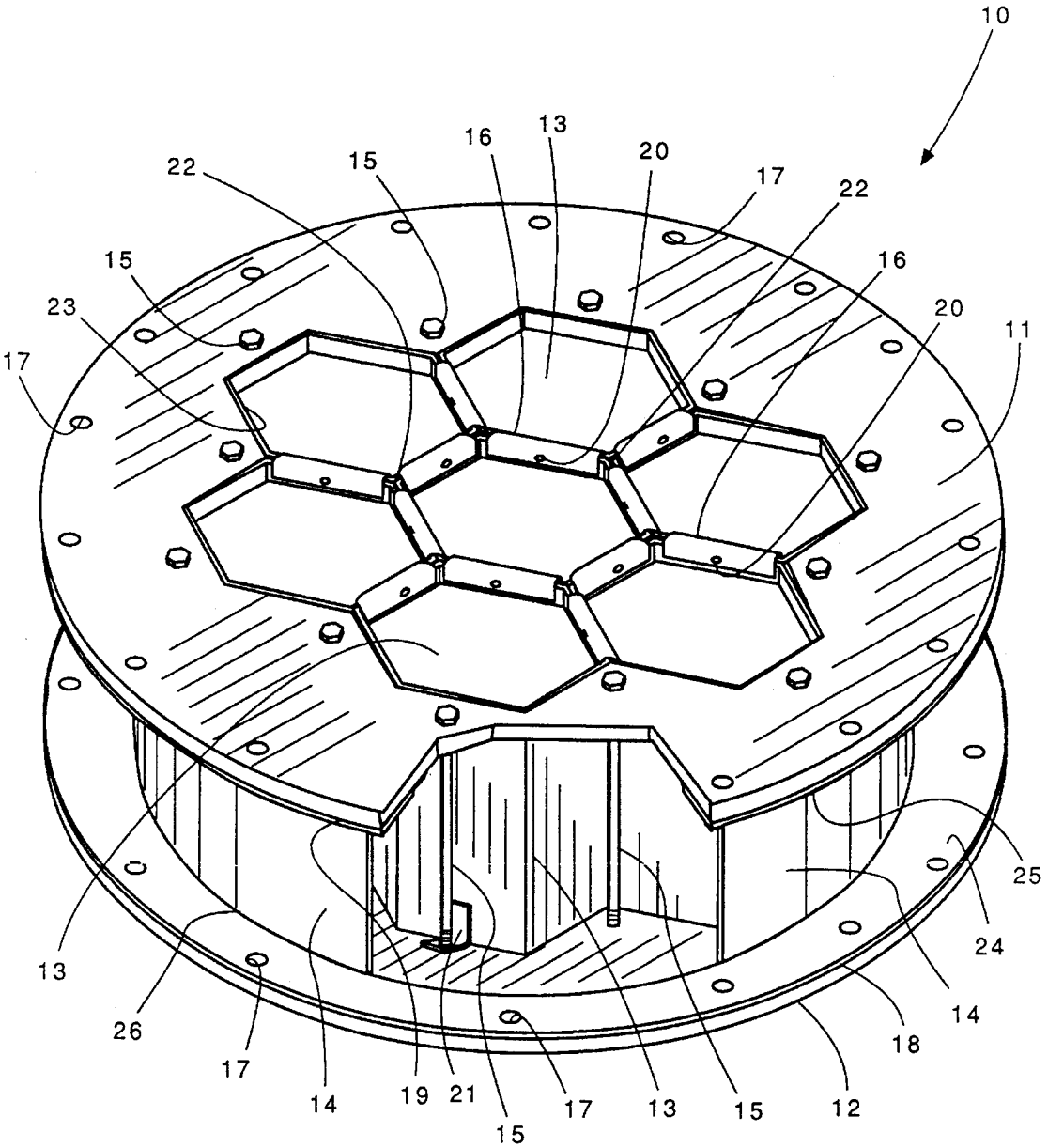
FIG. 1 is an isometric view of a catalytic converter exhaust section according to one embodiment of the present invention.
Figure 2:
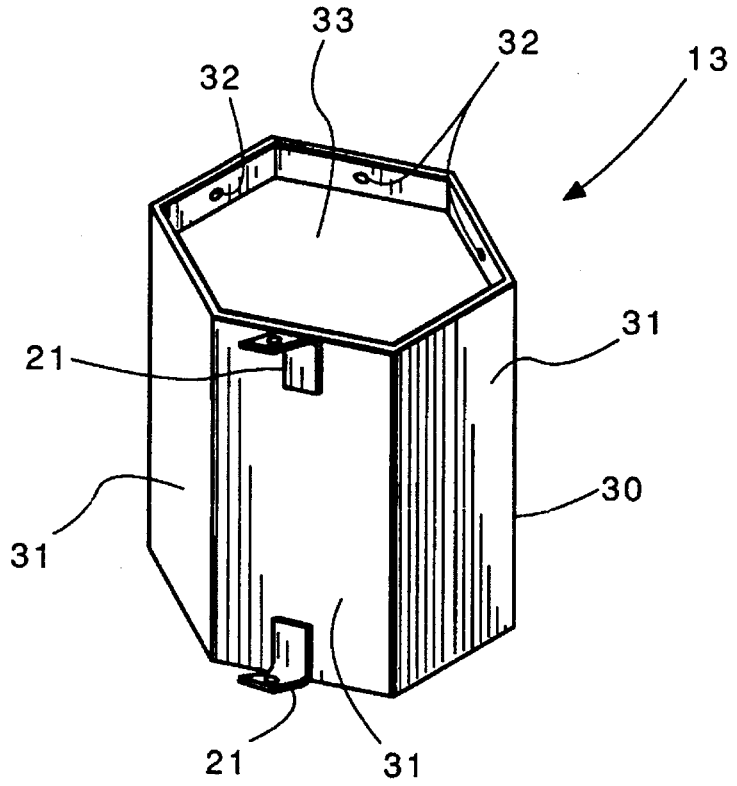
FIG. 2 is an isometric view of a monolithic catalytic converter substrate according to one aspect of the present invention.
Figure 3:
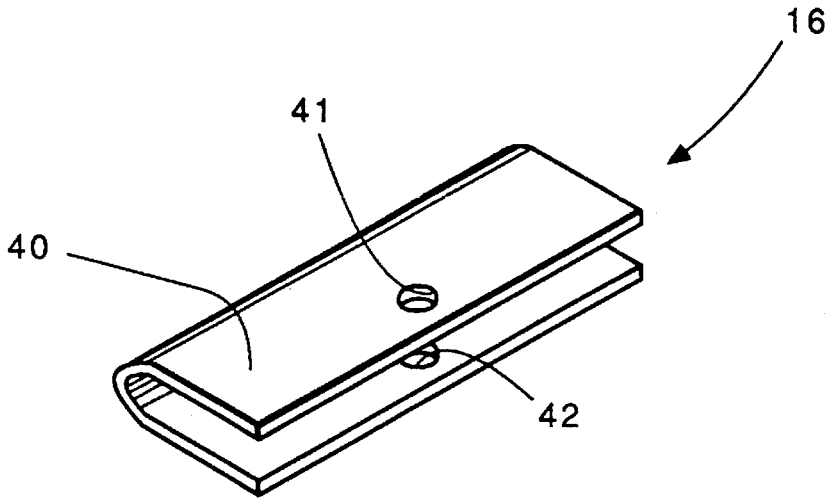
FIG. 3 is an isometric view of a clip utilized to join catalytic converter substrates according to one aspect of the present invention.

Referring now to FIGS. 1–3, a catalytic converter exhaust section 10 according to one embodiment of the present invention includes a first mounting plate 11, a second mounting plate 12, a plurality of hexagonally shaped monolithic catalytic converter substrates 13 and a hollow cylindrically shaped tube 14. The length of hollow cylindrically shaped metallic tubing 14 is held in place between mounting plates 11 and 12 via a plurality of bolts 15 that extend through both mounting plates. Tube 14 is impervious to exhaust gas. Mounting plates 11 and 12 are preferably cut from steel plate having a suitable thickness in order to provide adequate structural strength. Both mounting plates also include a plurality of mounting bores 17 around its peripheral extended flange. Bores 17 permit the catalytic converter exhaust section 10 to be bolted into an exhaust line from an internal combustion engine in a conventional manner. When installed, catalytic converter exhaust section 10 actually constitutes a portion of the exhaust line from an engine.

A pair of doughnut shaped metallic flanges 24 and 25 are welded along corner seam 26 to the outer surface of tube 14o Flanges 24 and 25 have an inner diameter about equal to the outer diameter of tube 14. The seam weld 26 prevents exhaust gases from escaping between the edge of tube 14 and flanges 24 and 25. A pair of doughnut shaped gaskets are compressed between respective flanges 24 and 25 and the inner faces of their respective mounting plates 12 and 11. In other words, gaskets 18 and 19 are not fully compressed to prevent exhaust leakage between flanges 24, 25 and the inner surfaces of mounting plates 11, 12 until exhaust section 10 is bolted into an exhaust line via mounting bores 17, which extend through the mounting plates, the gaskets and the flanges.

Each catalytic converter substrate 13 is identically shaped in a regular hexagonal cross section 30 that includes six planer rectangular walls 31. Hexagonal metallic substrates 13 are well known in the art and commercially available from EMITEC. In the applications of the present invention, the substrates have an inner hexagonal portion 33 coated with an appropriate catalyst for treatment of a particular component of the exhaust from an internal combustion engine. Inner portion 33 is preferably shorter than planar walls 31 in order to leave space for attachment bores 32, which facilitate attaching the various substrates 13 via clips 16. Each substrate has a cross sectional diameter on the order of six inches or more. Regular hexagons are utilized in the present invention because of their ability to be arranged in parallel with a minimum waste of space. In other words, the substrates are arranged in a honeycomb pattern than includes a central substrate surrounded by six peripheral catalytic converter substrates, with the ability to add one or two additional rings of substrates to the honeycomb if needed for a particular application.

The outer planer wall of all the outer catalytic converter substrates include a pair of L-shaped brackets 21 that receive bolts 15 as partially shown in FIG. 1; the center substrate has no brackets. The compound honeycomb cross section is assembled by inserting rivets 20 through aligned bores in adjacent planer walls 31 of each contiguous pair of catalytic converter substrates 13. Clips 16 are preferably simply a rectangular shaped piece of sheet metal 40 bent in a U shape, and includes aligned bores 41 and 42 which align with bores 32 made in the planer walls of the individual catalytic converter substrates. Clips 16 serve as a means for attaching the individual substrates into the honeycomb pattern shown and also prevent exhaust leakage between the individual substrates. Exhaust leakage at the corner junctions 22 of the substrates is prevented by the insertion of a wire mesh plug, or any other suitable material.

When assembled, the compound honeycomb cross section includes an outer border defined by the outer exposed planer walls of the peripheral substrates. Each mounting plate includes an opening 23 therethrough that is about the same shape as the outer border of the compound honeycomb cross section, but just smaller so that about a quarter of an inch of the plates extends inward to cover the outer edge of the honeycomb. Since each of the catalytic converter substrates 13 have a length about equal to the length of tube 14, the innerface of mounting plates 11 and 12 make metal to metal contact with the outer border edge of the honeycomb. This contact along with the L-shaped brackets 21 hold the compound honeycomb cross section in place within tube 14 and between mounting plates 11 and 12.

If desirable, a pair of lifting eyes can be welded to the outer surface of tube 14 to aid servicing personnel in removal of exhaust section 10 from the exhaust system of an engine. During servicing, the complete exhaust section 10 is removed from the engine's exhaust system and disassembled. Individual substrates are then replaceable by simply drilling out appropriate rivets 20, replacing the substrate and then re-riveting the substrates into the honeycomb pattern shown. The exhaust section 10 is then reassembled and mounted back into the exhaust system for the engine.

Figure 4:
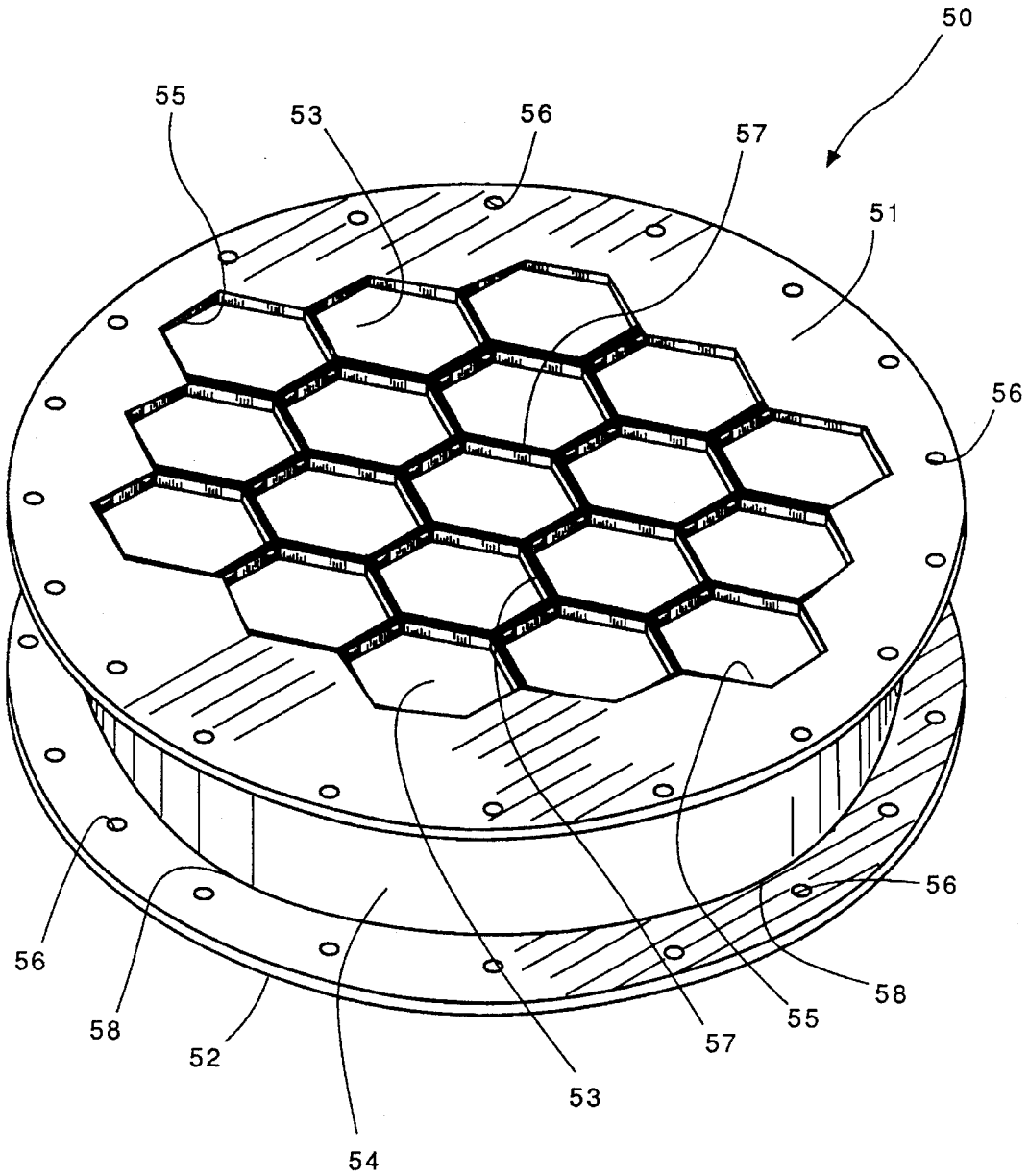
FIG. 4 is an isometric view of a catalytic converter exhaust section according to another embodiment of the present invention.

FIG. 4 shows a catalytic converter exhaust section 50 according to another embodiment of the present invention. In this embodiment, the various components are welded together rather than assembled using mechanical fasteners as in the prior embodiment. In particular, exhaust section 50 includes a first mounting plate 51, a second mounting plate 52, a hollow cylindrically shaped tube 54 and a plurality of hexagonally shaped monolithic catalytic converter substrates 53 arranged in a honeycomb pattern. In this embodiment, nineteen individual catalytic converter substrates of the type shown in FIG. 2 are welded along their adjoining edges 57. The welding not only provides the compound honeycomb cross section with structural integrity, but also prevents leakage between the individual substrates. Like the earlier embodiment, mounting plates 51 and 52 include an opening 55 that is about the same shape and size as the outer border of the compound honeycomb cross section. A seam weld attaches plates 51 and 52 to the outer edge of the honeycomb cross section. The assembly is completed by a seam weld around the adjoining edges 58 of tube 54 and the innerfaces of mounting plates 51 and 52. As with the earlier embodiment, the mounting plates include a plurality of mounting bores 56 arranged around its peripheral extended flange in order to facilitate mounting exhaust section 50 in the exhaust system from an engine.

Industrial Applicability

When in operation, catalytic converter exhaust sections 10, 50 are chosen to have an appropriate cross section for treatment of exhaust from a particular engine without creating unwanted back pressure on the engine. In the embodiment shown, either seven or nineteen monolithic catalytic converter substrates are assembled in the honeycomb pattern shown. The invention also contemplates the possibility of thirty-seven individual catalytic converter substrates in cases of extremely large engines requiring an even larger catalytic converter cross section in order to adequately treat the exhaust. In some applications, two or more catalytic converter exhaust sections in accordance with the present invention are mounted in parallel.

Regular hexagonal catalytic converter substrates are chosen for the present invention particularly for their ability to be arranged in a honeycomb pattern with little or no lost space. Furthermore, hexagonal substrates provide a honeycomb which can be mounted in a cylindrical cross section unit for more efficiency than the assemblage of a plurality of square catalytic substrates.

It should be noted that the above description is intended for illustration purposes only. Those skilled in the art will immediately recognize additional variations which fall within the intended scope of the present invention. For instance, other regular cross sections, such as triangles, may be assembled in a relatively large honeycomb pattern with adequate structural strength and a minimal waste of space as in the above described embodiments. In any event, the actual scope of the invention is defined solely by the claims as set forth below.

We claim:

1. A catalytic converter exhaust section comprising:

a first mounting plate with an inlet opening therethrough;

a second mounting plate with an outlet opening therethrough;

a plurality of substantially identical metallic catalytic converter substrates, each having a hexagonal cross section and an inlet end separated from an outlet end by six planar walls;

said metallic substrates being attached to one another in parallel to form a compound cross section with an inlet side, an outlet side and an outer border defined by a portion of said planar walls, and said planar walls of adjacent metallic substrates being in contact with one another;

a hollow cylindrically shaped tube with an inlet end separated from an outlet end by a wall impervious to exhaust, and being sized to surround said compound cross section; and means for affixing said compound cross section within said tube and between said first mounting plate and said second mounting plate such that said inlet opening of said first mounting plate opens to said inlet side of said compound cross section and said outlet opening of said second mounting plate opens to said outlet side of said compound cross section.

2. The exhaust section of claim 1, wherein each of said mounting plates has an extended flange with a plurality of mounting bores therethrough that are arranged around the periphery of said extended flange outside of said tube.

3. The exhaust section of claim 2, wherein said outer border of said compound cross section is shaped and sized about the same as said inlet opening and said outlet opening.

4. The exhaust section of claim 3, wherein said compound cross section is substantially circular and selected from a group consisting of seven, nineteen and thirty-seven substrates.

5. The exhaust section of claim 1, wherein said means for affixing includes a plurality of welds.

6. The exhaust section of claim 1, wherein said means for affixing includes a plurality of mechanical fasteners.

7. The exhaust section of claim 6, wherein said outer border includes a plurality of brackets with bolt holes therethrough attached to a plurality of different planar walls in spaced intervals around said outer border;

said mounting plates include a plurality of bolt holes therethrough, a portion of which align with counterpart bolt holes through said brackets; and said mechanical fasteners include a plurality of bolts extending through said mounting plates, said brackets and said tube, and a nut mated to the end of each of said bolts.

8. The exhaust section of claim 7, wherein adjacent substrates of said compound cross section are clipped together with a plurality of clips.

9. The exhaust section of claim 6, further comprising:

said first mounting plate having a first flange attached adjacent one end of said tube, and having plurality of mounting bores therethrough;

a first gasket positioned between said first flange and said first mounting plate;

said second mounting plate having a second flange attached adjacent one end of said tube, and having a plurality of mounting bores therethrough; and a second gasket positioned between said second flange and said second mounting plate.

* * * * *